US005711334A

United States Patent [19]

Roux

[11] Patent Number: 5,711,334

[45] Date of Patent: Jan. 27, 1998

[54] AMBULATORY AID

[76] Inventor: Christian Roux, 561 Woodlawn, Ypsilanti, Mich. 48198

[21] Appl. No.: 769,502

[22] Filed: Dec. 18, 1996

[51] Int. Cl.[6] ..... A61H 3/02; A45B 1/00

[52] U.S. Cl. ..... 135/65; 135/66; 135/68; 135/69; 135/71

[58] Field of Search ..... 135/65, 66, 68, 135/69, 71, 72, 73, 75, 76; D3/7

[56] References Cited

U.S. PATENT DOCUMENTS

| | | | |
|---|---|---|---|
| D. 204,849 | 5/1965 | Thomas et al. | 135/69 |
| 1,192,290 | 7/1916 | Engstrom | 135/69 |
| 2,197,279 | 4/1940 | Thorssen . | |
| 2,198,082 | 4/1940 | Harty | 135/66 X |
| 2,516,852 | 8/1950 | Burry et al. . | |
| 3,157,189 | 11/1964 | Farnham | 135/69 |
| 3,269,399 | 8/1966 | Smith . | |
| 3,517,678 | 6/1970 | Gilsdorf . | |
| 3,635,233 | 1/1972 | Robertson | 135/71 |
| 3,683,535 | 8/1972 | Lewis . | |
| 3,710,807 | 1/1973 | Ferry | 135/68 |
| 3,717,359 | 2/1973 | Peronnon et al. . | |
| 3,757,807 | 9/1973 | Manzo . | |
| 3,947,140 | 3/1976 | Thomas | 135/69 X |
| 4,151,853 | 5/1979 | Inbar . | |
| 4,572,227 | 2/1986 | Wheeler . | |
| 4,730,632 | 3/1988 | Mace . | |
| 4,964,192 | 10/1990 | Marui . | |
| 5,458,143 | 10/1995 | Herr | 135/68 |
| 5,482,070 | 1/1996 | Kelly | 135/66 |

FOREIGN PATENT DOCUMENTS

| | | | |
|---|---|---|---|
| 650920A5 | 8/1985 | Switzerland . | |
| 685809A5 | 10/1995 | Switzerland . | |
| 106904 | 6/1917 | United Kingdom | 135/72 |

*Primary Examiner*—Wynn E. Wood
*Attorney, Agent, or Firm*—Brooks & Kushman P.C.

[57] ABSTRACT

An ambulatory aid for use by handicapped or disabled persons. The aid has a middle section (1) including an upper section-receiving and hand grip-supporting region (12). A hand grip (5) extends from the region, the hand grip (5) defining a longitudinal axis extending therethrough, the longitudinal axis and the region defining therebetween an angle less than 90°. An upper section (2) is slidingly receivable within the upper section-receiving and hand grip-supporting region (12) of the middle section (1). A forearm-engaging ring member (4) is supported for rotation from the upper section (2). The ring member, the upper section (12), the handle (5), and the middle section (1) form a disengageable, multi-functional assembly which serves either as a crutch in its assembled form, or as a cane in its disassembled form.

12 Claims, 4 Drawing Sheets

AMBULATORY AID

TECHNICAL FIELD

This invention relates to an ambulatory aid in the form of a combined crutch and cane with an anatomic handgrip.

BACKGROUND ART

Orthopedic devices in the form of a crutch are known in the art. For example, U.S. Pat. No. 3,757,807 discloses a crutch or cane which has a lower column and an upper column extending therefrom. A handle or hand grip is provided at the upper end of the lower column. A forearm-engaging cuff extends from the upper end of the upper column.

Such devices, however, do not readily lend themselves to alternative use as a crutch or as a cane from which the upper column has been removed.

These and other features, aspects, and advantages of the present invention will become better understood with regard to the following description, appended claims, and accompanying drawings.

SUMMARY OF THE INVENTION

One object of the invention is to create a better combination crutch/cane that can be used by handicapped people with varying degrees of illness, with short or long term disabilities, or by amputees needing better balance, and by elders needing assistance when walking with a cane.

An upper section is slidingly receivable within the upper section-receiving and hand grip-supporting region of the middle section. A forearm-engaging ring member is supported for rotation from the upper section.

The ring member, the upper section, the handle, and the middle section form a removable, multi-functional assembly which serves either as a crutch in its assembled form, or as a cane in its disassembled form.

DETAILED DESCRIPTION

The present invention concerns a multi-purpose ambulatory aid which, in its assembled form, serves as a crutch. In its disassembled form, the invention serves as a cane. The aid has a middle section 1, an upper section 2, a foot 8, an open (forearm-engaging) ring 4, and an anatomical, adaptable handle (hand grip) 5. The upper section 2 is removable from middle section 1, thus providing the optional availability of a crutch or a cane. Thus, the invention discloses a crutch or cane in which the functional attributes of each are available in one combinable unit.

Figure 10:
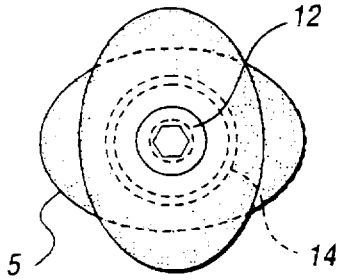
FIG. 10 is an end view of the handle as seen from the left-hand side of FIG. 7.

Turning first to FIGS. 1–6, the middle section 1 is angled at bend 7, thereby forming an upper section-receiving and hand grip-supporting region 12 thereabove. Below the bend 7, a securing arm 6 extends toward the handle 5 so that the handle 5 may be secured between the region 12 and securing arm 6. The handle 5 is detachably connected for use by the left or right hand. This handle (or hand grip) 5 has a variable cross-section (FIGS. 7–10) and has a surface that anatomically conforms to the inside of the palm of a hand which clasps the hand grip. The two end areas (FIG. 10) are oval or elliptical in shape, whereby the long axes of the end areas are offset from each other by approximately 90°.

The longitudinal cross-section (FIG. 9) shows that the width of the longitudinal cross-section of the hand grip 5, reduces on the top and bottom sides.

Figure 7:
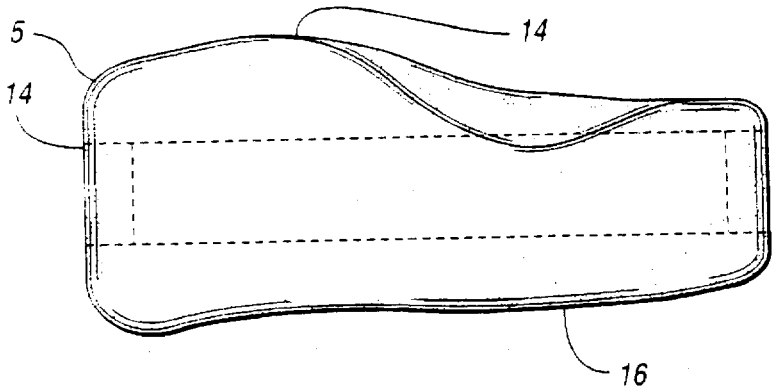
FIG. 7 is a top view of the handle.
Figure 8:
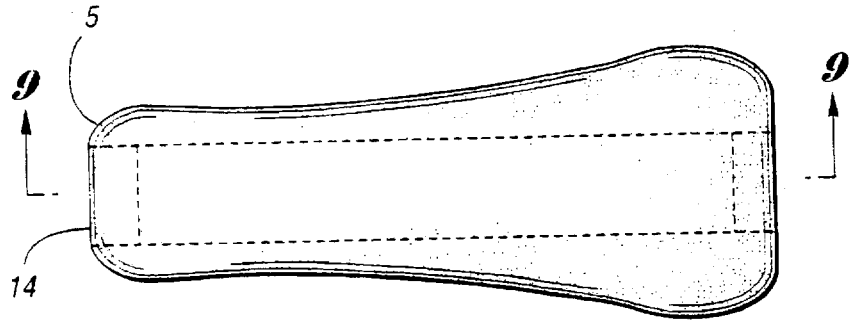
FIG. 8 is a side view of the handle.
Figure 9:
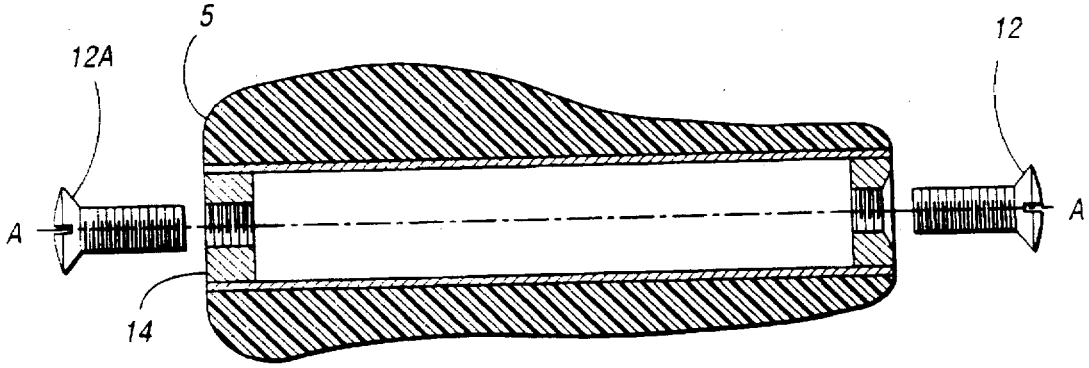
FIG. 9 is a sectional view of the handle depicted in FIG. 8 along the line 9—9.

It is possible to use only one mold of two parts for both right and left handle 5, as opposed to two molds of four parts for right and left handles. Under prior art approaches, separate molds were required—one for forming a handle for use by the right hand; and the other for forming a handle for use by the other hand. Each mold had two cavities. But in the present invention, the right handle, FIG. 9, when turned 180° about its longitudinal axis A—A, has exactly the anatomic hand print for the left hand grip. In FIG. 7, for example, the handle 5 has an upper surface 14 and a lower surface 16. The surface 14 conforms to the right hand of the user. When the handle 5 is rotated through 180°, the surface 16 is conformable with the left hand of the user.

Returning to the upper section 2 of the assembly, an open ring-shaped arm rest or member 4 is provided that turns 360° about an axis B—B which preferably is parallel to the axis of rotation A—A of the handle 5. In the upper and lower regions 10A and 10 of the middle section 1, holes are provided for insertion of a fastener, such as a lock bolt. Holes are also provided in the upper section 2 and in the foot 8. Since the upper part 2 as well as the foot piece 3 are arranged telescopically, the combined crutch/cane assembly can be adjusted to any body size by ½ inch and 1 inch increments. In one embodiment, the upper section 1 of the front of the crutch/cane (FIG. 3) has 11 hole adjustments, one inch apart, totaling 11 inches for changing positions. Thus, the aid is adjustable from the size for an 8 year old child to a full grown 6' 5" adult. When part 3 is removed and turned, each half inch section is in the middle position from the front holes. Thus, adjustment is also made by a 180° rotation of the foot piece 8 in relation to the middle section 1. If desired, a set screw 10C (FIG. 5) is provided in the bolt 10, 10A, 10B, 10C, screwable in a direction against the outside wall of the upper middle section 1, and the bottom part 1 of the foot 3 and/or on the back side of the crutch/cane. The desired length of the crutch/cane can be quickly adjusted and safely locked at the desired length.

The invention permits a more erect, i.e. better body posture, in contrast with several prior art crutches which require the user to lean forward. The arm rest is angled and balanced with the handle to provide a more rearward center of gravity. It provides increased safety, since the lower arm and wrist assume an optimized position which burdens the handicapped the least. The crutches, if not used, can remain on the lower arm of the handicapped due to the open arm rests. If the patient should fall, his forearm can slip out of the opened arm rest (FIG. 5) to avoid further injury. The forearm-engaging ring 4 is flexible and has an open space to disengage the arm when pressure is applied. The ring 4 also turns about an axis B—B of rotation (FIGS. 3 and 4) through 360° so the patient is not entrapped by the forearm-engaging ring 4.

The angle of the handle (and therefore of the wrist) is inclined in relation to the upper part 2, compared to other crutches (FIGS. 1 and 2), giving the user less pain in the wrist and lower arm from usage. The upper region 2 of the upper part connected to the arm rest 4 is angled in relation to the middle section 1 and is balanced with the hand grip. Thus, the forces exerted by the weight of the user on the assembly grip are distributed through the user's hand (located on the handle) and through the forearm of the user (as located in the forearm-engaging ring 4).

The hand grip 5 is detachably connected to the middle section 1. The upper section 2 is slidably engagable with the middle section 1. The foot 3 is also slidably adjustable relative to the lower region of the middle section 1. Each of these members is slidable and lockable.

The middle section 1, the upper part 2, and the foot piece 3 can be made of square or round tubing made of a suitable lightweight material, such as aluminum or titanium.

In the upper part 2, and in the foot piece 3, there is optionally provided an engaging means, such as a spring 10B, and loaded bolt 10A (FIG. 5), which engage in a locked position with one of several holes provided in the upper and lower region 10 and 10A of the middle section.

Figure 1:
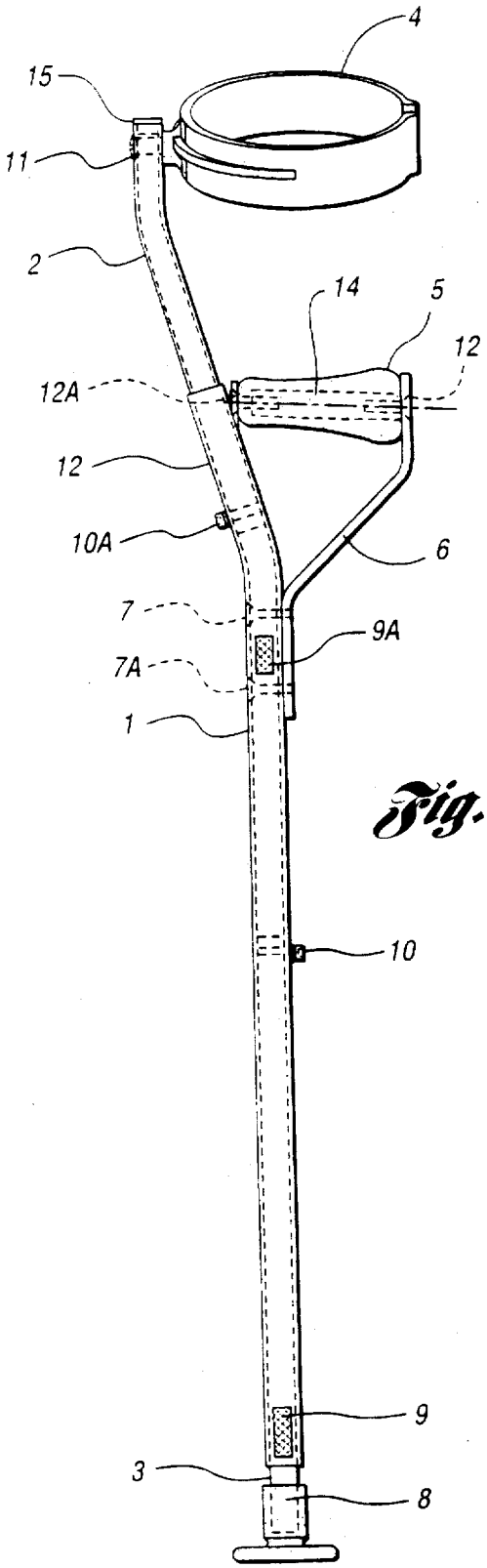
FIG. 1 is a side view of the ambulatory aid.
Figure 2:
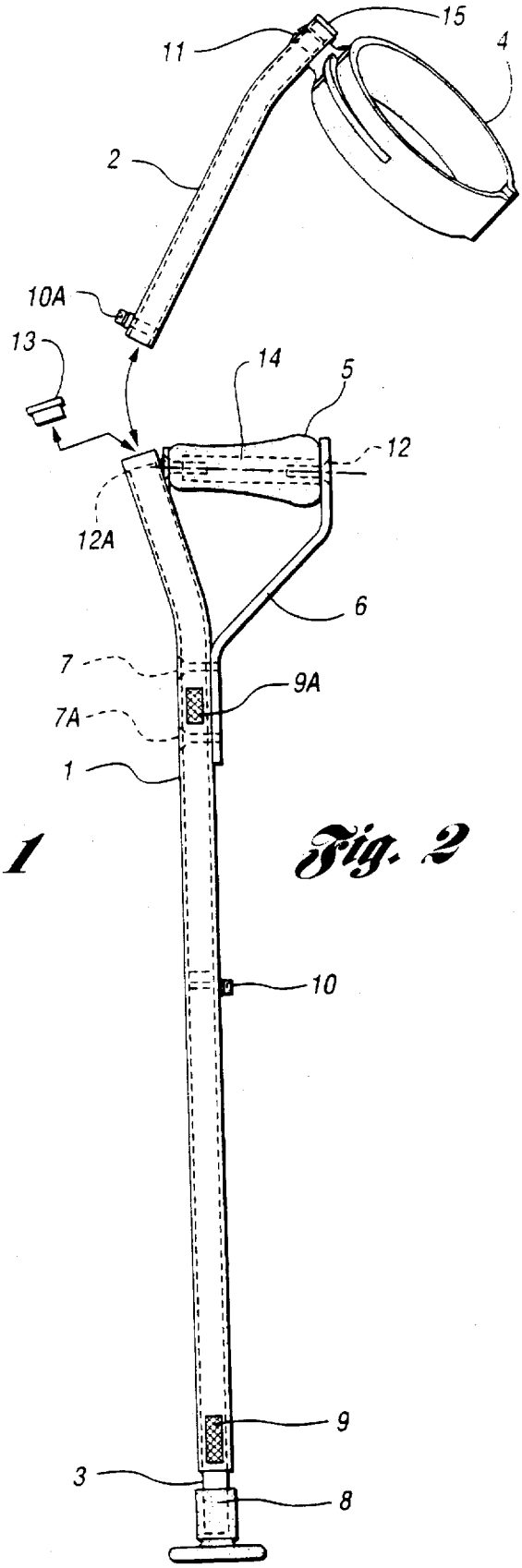
FIG. 2 is a side view of the ambulatory aid broken down to cane form.
Figure 3:
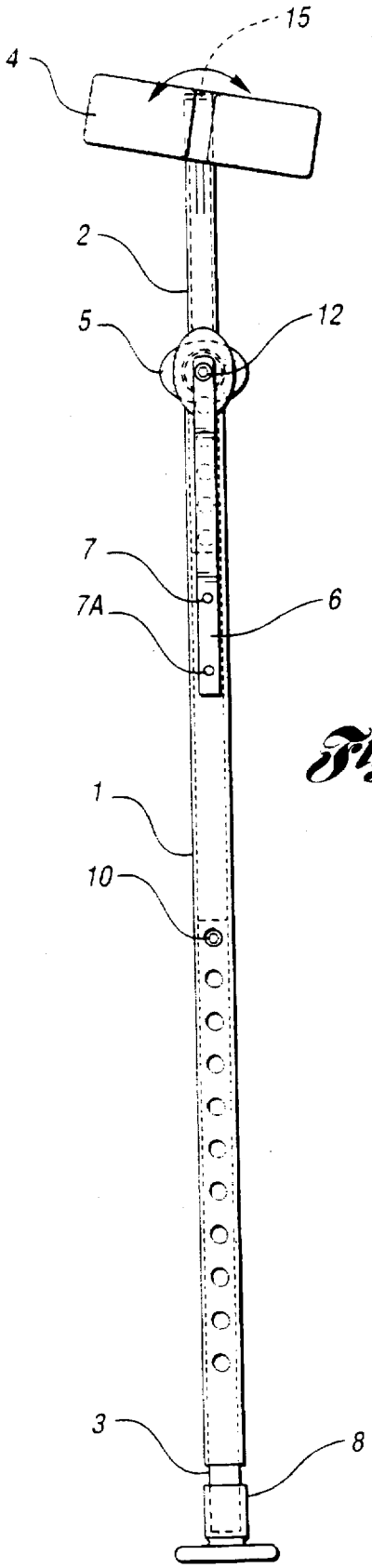
FIG. 3 is a front view of the ambulatory aid shown in the lowest adjustment position.
Figure 4:
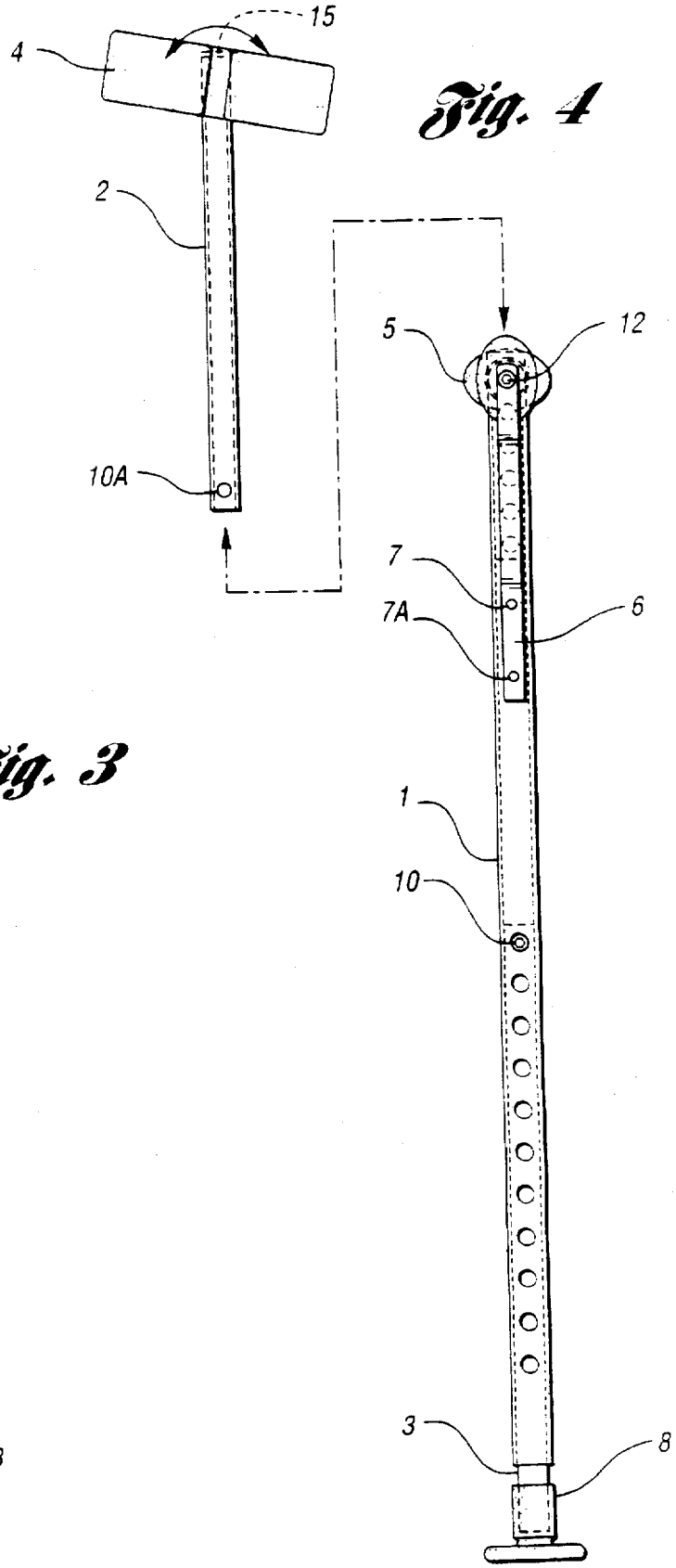
FIG. 4 is a front view of crutch/cane broken down to cane form.
Figure 5:
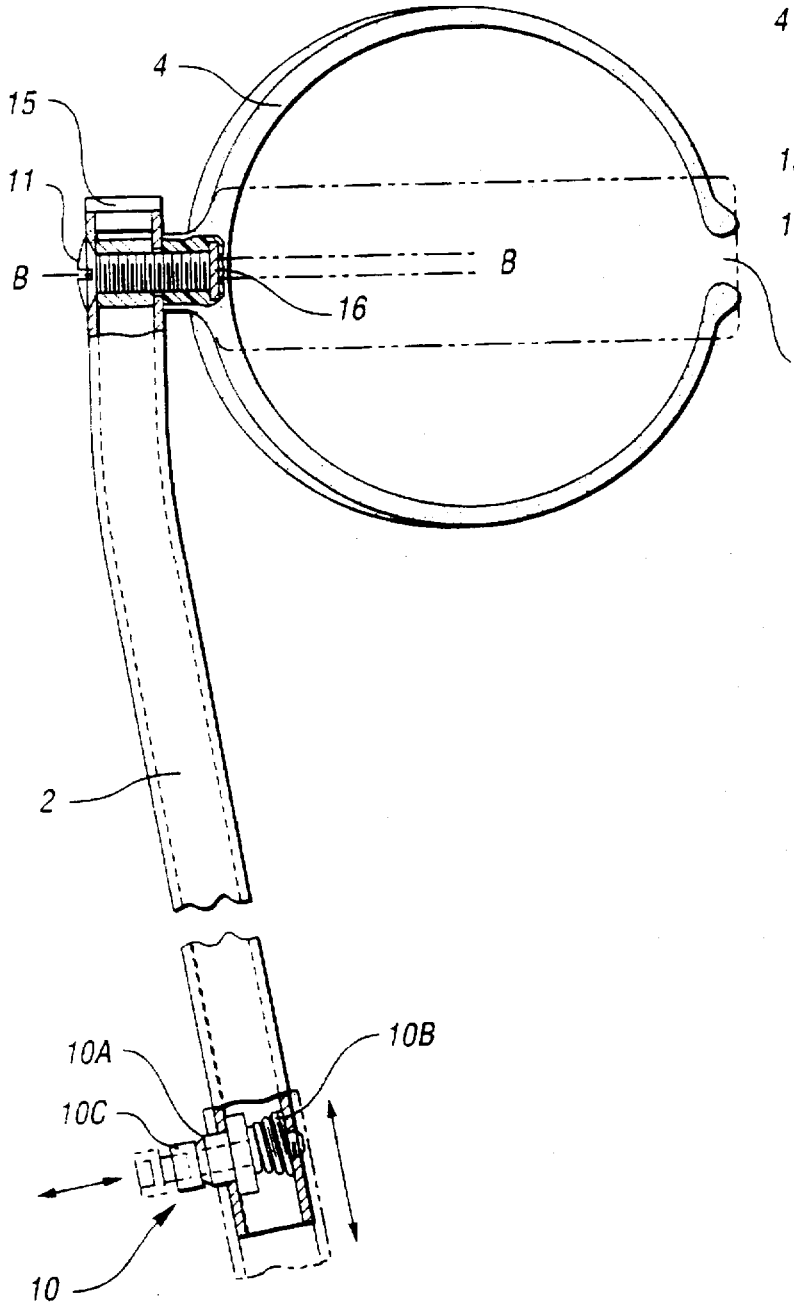
FIG. 5 is an enlarged side view of the forearm-engaging ring member extending from the upper section.
Figure 6:
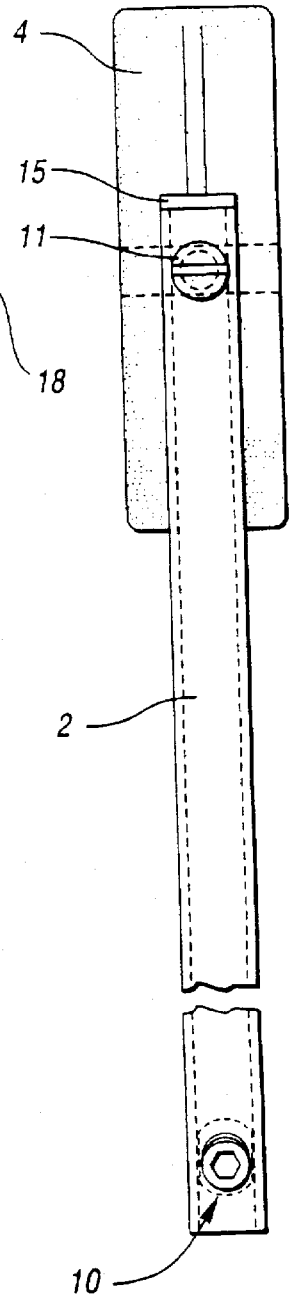
FIG. 6 is a rear view of the structure depicted in FIG. 5.

As best shown in FIG. 5, the rotatable forearm-engaging ring 4 extending from the upper section 2 is connected so that the screw 16 is melted in the forearm-engaging ring 4. The synthetic forearm-engaging ring is made of PVC or rubber to provide security so that the screw will not reverse and the forearm-engaging ring 4 will not fall off. Also on the back side is a casing with an inside thread security screw 11 for security.

If desired, a cap 13 can be inserted to cover the top of the middle section 1 when the device is used as a cane.

The hand grip 5 finds many applications for example, in the area of sports, in the machine industry, tools, agriculture, and in the military (weapons).

Optionally, a safety feature of light reflectors 9 can be provided on all four sides. Additionally, the crutch/cane assembly is lightweight.

In an alternative embodiment, one or each handle defines a longitudinally extending orifice for receiving a key by which fastening devices for locking the telescopically cooperating members may be engaged.

What is claimed is:

1. An ambulatory aid for use by handicapped or disabled persons, comprising:

a middle section including an upper section-receiving region and hand grip-supporting region;

a hand grip extending from the hand grip-supporting region to the upper section-receiving region, the hand grip including a longitudinal axis A—A, the longitudinal axis and the upper section-receiving region defining therebetween an angle less than 90°;

an upper section slidingly receivable within the upper section-receiving region of the middle section; and a forearm-engaging ring member supported for rotation from the upper section about a fixed axis of rotation B—B, the ring member, the upper section, the handle and the middle section thereby forming a combined crutch-cane assembly.

2. The aid of claim 1 also including:

a bracket extending from the middle section upwardly and outwardly to receive the handle.

3. The aid of claim 2 further comprising:

a cap for insertion at the top of the upper section-receiving and hand grip-supporting region when the upper section is removed and the aid is used as a cane.

4. The aid of claim 1 wherein the axis of rotation B—B is substantially parallel to the longitudinal axis A—A of the handle.

5. The aid of claim 1 wherein the handle has an upper surface and a lower surface, the surfaces being topographically conformed to the user's palm when the surfaces are in a relaxed state, the upper surface being conformable with the user's right hand, the lower surface being conformable with the user's left hand when the handle is rotated 180° about the longitudinal axis A—A.

6. The aid of claim 1 wherein:

the forearm-engaging ring includes an open segment, the ring being formed of a deformable material so that the ring may be readily disengaged from the user's forearm through the open segment.

7. The aid of claim 1 further including a light reflector positioned upon the middle section.

8. The aid of claim 1 further including a light reflector positioned upon the upper section.

9. The aid of claim 1 further comprising:

a foot which is telescopically engageable with the middle section.

10. The aid of claim 1 wherein the upper section and middle section are square in cross section.

11. The aid of claim 9 wherein the foot and the middle section are rectangular in cross section.

12. The aid of claim 11 wherein the foot, the middle section, and the upper section are each rectangular in cross section.

* * * * *